United States Patent [19]

Hynes et al.

[11] 4,358,903

[45] Nov. 16, 1982

[54] WEDGE BONDED SHOE WELTING

[75] Inventors: Richard K. Hynes, East Bridgewater; Robert W. Hynes, Brockton, both of Mass.

[73] Assignee: Barbour Welting Company, Inc., Brockton, Mass.

[21] Appl. No.: 121,650

[22] Filed: Feb. 15, 1980

[51] Int. Cl.[3] ..... A43B 15/00; A43B 13/18

[52] U.S. Cl. ..... 36/78; 36/17 PW; 12/146 W

[58] Field of Search ..... 36/78, 17; 12/146 W

[56] References Cited

U.S. PATENT DOCUMENTS

| | | | |
|---|---|---|---|
| Re. 19,555 | 4/1935 | Sleeper | 36/78 X |
| 1,772,178 | 8/1930 | Fallon, Jr. | 12/146 W |
| 2,093,523 | 9/1937 | Kiyomara | 36/78 X |
| 2,477,532 | 7/1949 | White | 12/146 W |
| 2,494,786 | 1/1950 | Vizard | 12/146 W |
| 2,775,829 | 1/1957 | Vizard | 36/78 |
| 3,113,388 | 12/1963 | Rubico | 36/78 |

FOREIGN PATENT DOCUMENTS

| | | | |
|---|---|---|---|
| 960524 | 3/1957 | Fed. Rep. of Germany | 36/78 |

*Primary Examiner*—James Kee Chi

*Attorney, Agent, or Firm*—Weingarten, Schurgin & Gagnebin

[57] ABSTRACT

A wedge bonded shoe welting is provided comprising fibrous and non-fibrous component members which has the strength, pliability, and appearance of genuine leather welting and the ability to be trimmed and finished as leather welting but at lower cost.

7 Claims, 10 Drawing Figures

WEDGE BONDED SHOE WELTING

FIELD OF THE INVENTION

The present invention relates in general to shoe welting and in particular to a unique two-part wedge bonded shoe welting and the process for making the same.

BACKGROUND OF THE INVENTION

The traditional method for well-made, water-resistant, walking shoes has been the machine welting process, which is a mechanized version of the older, hand-sewn welting method. A machine welted shoe provides distinct advantages. Because of the indirect attachment of the outer sole to the shoe upper via the welting, the sole can be replaced a number of times, and the repaired shoe has a better shape retention. In addition, a welted shoe is generally more comfortable and water-resistant than non-welted shoe constructions. On the other hand, the production of a machine welted shoe requires a high degree of skill and labor compared to other available methods and demands the use of good quality materials. These factors raise the cost of machine welted shoes considerably.

Traditionally, genuine leather has been the material of choice for shoe welting. Genuine leather has fiber integrity, the orderly arrangement and cross-linkage of natural leather fibers; this fiber integrity gives true leather its notable strength and allows it to withstand the tremendous lateral stresses imposed by the inseaming operation during attachment to the shoe upper and later by Goodyear stitching to the outer sole. Leather welting provides pliability, strength, color, and the fine leather finish which is the marketing attraction of a well-made shoe. Economic conditions, however, have forced the price of genuine leather to extreme levels for many shoe manufacturers. Substitutes have been sought which would provide all the advantages of genuine leather welting and at reduced cost. Current non-leather substitutes for shoe welting include plastic resins, such as polyvinylchloride (PVC), PVC compound derivatives having nitrile rubber content, natural rubbers, and synthetic rubbers, such as neoprene and its derivatives. Such materials provide the requisite pliability and strength for use as shoe welting in Goodyear and Silhouwelt constructed shoes. They do not, however, have the ability to trim and finish like genuine leather welting, and thus are unsuitable for that portion of the shoe market which desires real leather or leather-looking shoes.

Laminated shoe weltings, comprising multiple layers of varying material type, are known. The Fallon U.S. Pat. No. 1,854,183 and Vizard U.S. Pat. No. 2,403,694 describe two-ply laminated weltings having first and second layers of flexible material. Similarly, the patents of Gorman, U.S. Pat. No. 2,114,131; Heft, U.S. Pat. No. 2,023,380; Fallon U.S. Pat. No. 1,762,967; Shaw U.S. Pat. No. 1,188,497; Ridderstrom, U.S. Pat. No. 2,627,079; Wright, U.S. Pat. No. 2,348,583; Hood, U.S. Pat. No. 1,204,769; Sleeper, U.S. Pat. No. RE 19,555; and others, each describe varied laminated shoe weltings comprising two-layer or multiple-layer construction using diverse materials. None, however, provides a two-part wedge bonded shoe welting comprised of non-leather materials which are not ply laminated and can be trimmed and finished like genuine leather.

SUMMARY OF THE INVENTION

The present invention relates to shoe welting for Goodyear and Silhouwelt constructed shoes which has the pliability, strength, color, and capability to be trimmed and finished like genuine leather welting. A wedge bonded welting is provided comprising a broad beveled non-fibrous member which is bonded to a broad beveled fibrous member. Each member is coextensive with the other along their respective abutting beveled surfaces to form a single unit. A cost-saving and efficient process to obtain fibrous member components by transversely cutting a rectangular fillet of fiberboard material into two broad beveled members is provided. In addition, a method and apparatus by which to join the fibrous and nonfibrous members together as one wedge bonded welting is included.

When attached as part of an assembled shoe, the present invention permits the visibly exposed fibrous member to be trimmed and finished as genuine leather while the non-fibrous member remains hidden from external view. This wedge bonded welting offers distinct advantages by using fibrous materials which in themselves are incapable of withstanding Goodyear stitching to provide a non-leather welting for Goodyear stitched shoes whose appearance after finishing rivals that of a genuine leather but whose cost is dramatically lower.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
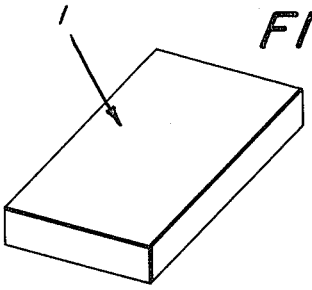
FIG. 1 is a pictorial view of the fibrous component material prior to cutting.

Referring to FIG. 1, there appears a "fillet" of fibrous material 1 known as fiberboard the width and thickness of which will be suitable for the size of the finished welting desired. For example, to make a one-half inch by one-eighth inch wedge laminated welting, a one-half inch by one-eighth inch fiberboard fillet is required. The preferred kind of fiberboard used in making the present invention is leather board, a manufactured board composed of leather fibers in a binder material. However, the present invention envisions the use of fiberboard fillets of any material providing an intended grain surface appearance. Nylon fiberboard or plastic fiberboard of varying chemical compositions will do equally well; so long as the fiberboard composition material permits trimming, roughing, and finishing to appear as leather, the composition of the fibers themselves is inconsequential.

Figure 2:
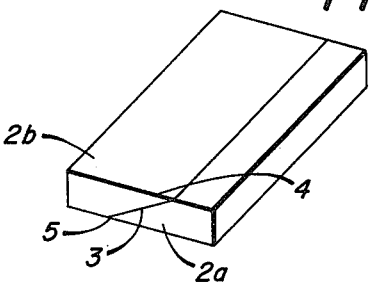
FIG. 2 is a pictorial view of the fibrous component material after cutting into two substantially trapezoidal-shaped members.

Referring to FIG. 2, there appears a fiberboard fillet which has been divided into two substantially trapezoidal-shaped members 2*a* and 2*b*. Beginning with a fiberboard fillet 1 of one-half inch by one-eighth inch dimensions, a cut 3 is made in one parallel surface 4 approximately one-eighth inch from the edge and traverses through the fillet 1 diagonally to the second parallel surface 5 stopping at the same distance from the opposite edge. The diagonally transverse cut 3 is at an approximate thirty degree angle relative to the parallel surface 4. The cut 3 is made in this manner to avoid any waste of fibrous material. The same profile, if cut from a single strand of three-eighths inch width fiberboard, would result in a triangular waste piece with a quarter inch base from each strand and an overall waste of one-quarter inch widths of stock for every two strands produced. By cutting the fillet 1 as described, two fibrous members 2*a* and 2*b*, each having a broad beveled surface, are produced with no waste at all.

Figure 3:
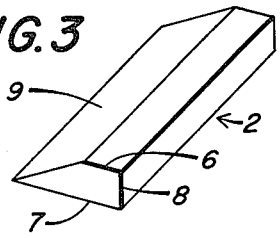
FIG. 3 is a pictorial view of one embodiment of the fibrous component formed in the manner shown in FIG. 2.

Referring to FIG. 3, there appears a fibrous member 2 obtained as herein described. It is substantially trapezoidal-shaped in cross-section, having two parallel outer surfaces 6 and 7 of unequal widths, a narrow end surface 8 perpendicularly disposed to both parallel surfaces 6 and 7, and a broad beveled side surface 9.

Figure 4:
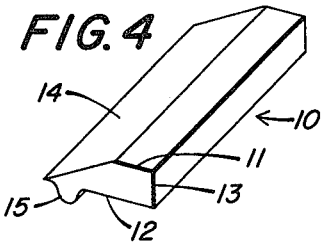
FIG. 4 is a pictorial view of another embodiment of the fibrous component member.

Another embodiment of the fibrous member component employed in the present invention appears in FIG. 4. Here, again, the fibrous member 10 is substantially trapezoidal-shaped in cross-section, having two unequal parallel outer surfaces 11 and 12, a narrow end surface 13, and a broad beveled side surface 14. A raised beading 15 is disposed on the parallel surface 12 along its entire length near one edge of the fibrous member. The raised beading 15 provides a fibrous member 10 with increased water resistance and shoe shape retention features to form a storm-type bonded welting; it may also serve as an ornamentation for dress shoes. The fibrous member 10 is composed of leather board or any other fiberboard material providing a grain surface. The member 10 is formed by cutting a fillet 1 of fiberboard with a formed knife whose edge is shaped in the desired configuration or by milling down a thicker strip of fiberboard to intended dimensions.

There is no requirement that any embodiment of the fibrous member employed in the present invention be substantially trapezoidal-shaped in cross-section. Parallel top and bottom surfaces are described in these embodiments as a matter of preference, but these are not essential to the practice of the invention. Neither is the fibrous member limited to four-sided figures; the cross-sectional perimeter may be varied in shape to suit the user's needs. The only essential requirements are that the outer and end surfaces have a grain appearance and a broad beveled surface be included as part of any embodiment of the fibrous member.

Figure 5:
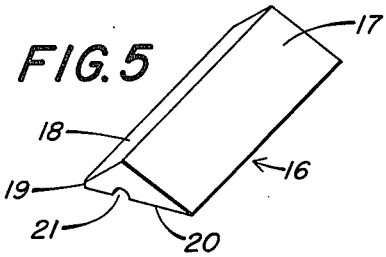
FIG. 5 is a pictorial view of one embodiment of the non-fibrous component member.

Referring to FIG. 5, there appears an embodiment of the non-fibrous component employed in the present invention. It is a non-fibrous elongated member 16 having a substantially trapezial cross-sectional shape, that is, a four-sided figure with no side parallel to any other. This non-fibrous member 16 has a broad beveled upper surface 17, a narrow adjoining beveled surface 18, a side wall 19, and a base 20 having a groove 21 extending along its entire length. This non-fibrous member 16 is formed by die extrusion and is composed of any non-fibrous matter which is both extrudable and pliant in nature. A thermoplastic resin such as polyvinylchloride resin (PVC) is preferred; however, any plastic, plastic derivative, true or synthetic rubber, or rubber derivative meeting the extrudability and pliability requirements is acceptable. Similarly, the trapezial cross-sectional shape is solely a configurational preference and not a necessary limitation. The only essential requirements include a base having a groove extending along its length and a broad beveled surface in any embodiment of the non-fibrous member.

Figure 6:
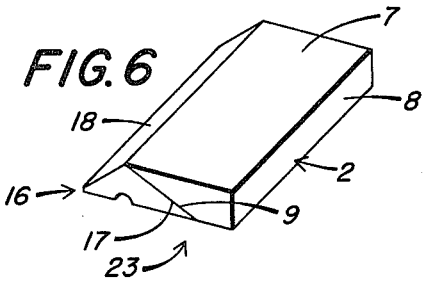
FIG. 6 is a pictorial view of one embodiment of the novel welt composed of the components of FIGS. 3 and 5.

Referring to FIG. 6, there appears one embodiment of the wedge bonded shoe welting 23 according to the present invention. The fibrous member 2 and the non-fibrous member 16 are joined together along their respective beveled or wedge-like surfaces to form one integral unit having five sides in cross-section. The broad beveled side surfaces 9 and 17 are coextensive and are bonded together along their length by a suitable cement. The base of the welting 23 is formed by the union of the base 20 of the non-fibrous member 16 and the surface 6 of the fibrous member 2. Neither the fibrous member 2 nor the non-fibrous member 16 serves as a laminated layer or reinforcing sheet for the other; neither extends under nor envelopes the other. Rather, each member 2 and 16 is an abutting support component forming a union along a diagonally extending boundary, the junction of the beveled sides 9 and 17. The outer surface 7 and the end surface 8 of the fibrous member alone have a grain suitable for finishing as a leather appearance. These surfaces 7 and 8 are that portion of the bonded welting 23 which will be visibly exposed to view as the exterior of an assembled shoe. It is thus essential that the base 20 of the non-fibrous member 16 not be extended in width to become, alone, the base of the bonded welting 23.

Figure 7:
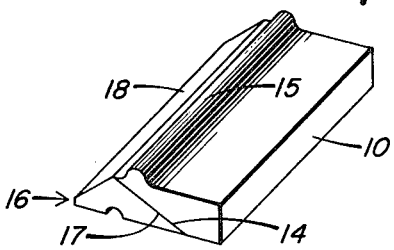
FIG. 7 is a pictorial view of another embodiment of the novel welt composed of the components of FIGS. 4 and 5.

Similarly, in FIG. 7, there appears another embodiment of the present invention employing the fibrous member 10 having a raised beading 15 disposed along its length. As before, the broad beveled side surface 14 is cemented along its entire length to the broad beveled upper surface 17 of the non-fibrous member 16. This embodiment provides the storm-type wedge bonded welting previously described.

Figure 8:
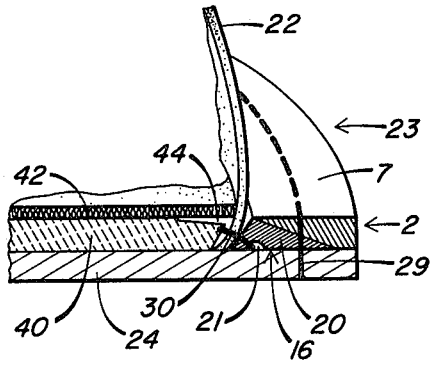
FIG. 8 is a sectional pictorial view of a finished shoe indicating the installation of the novel welt.

The present invention is typically affixed as part of an assembled shoe as shown in FIG. 8. The narrow beveled edge 18 of the laminated welting 23 abuts a portion of the upper 22, and the inseam stitching 30 is sewn from the groove 21 to the inseam rib 44 with the upper sandwiched between the rib and the welt edge 18. The rib is affixed to the insole 42 in usual manner. A ground cork or other filler 40 occupies the space between the insole 42 and outsole 24. The groove 21 is usually of circular or arcuate cross-section and is situated at an appropriate position as to insure penetration of the inseam needle solely within the non-fibrous member component during inseam stitching. The groove 21 allows the inseam stitching 30 to be recessed in the base 20 of the non-fibrous member 16, thus protecting the stitching from the trimming operation which follows. The outsole 24 is subsequently Goodyear stitched to the welting 23, the stitching 29 being through both the fibrous and non-fibrous members of the welt. The stitching 29 serves to further secure the cement bonded welt members together as well as functioning to affix the outsole to the shoe upper. By being both inseamed and Goodyear stitched, the welting 23 will better retain the shoe shape and will not curl away from the shoe upper 22 during ordinary wear.

Once the welting 23 is in an assembled shoe, the fibrous member 2 alone is visibly exposed as part of the shoe exterior and may be trimmed, roughed, and finished to look like leather. Examination of a completed shoe using the present invention reveals nothing other than the use of a leather-looking welting, since the non-fibrous member 16 remains invisible within the shoe interior.

The present invention has added distinct and important advantages over other shoe welts. It envisions using leather board or other fibrous composition board which cannot withstand stitching stress; although leather board is composed of one hundred percent leather fibers, it does not have the orderly alignment and cross-linkage of fibers which gives genuine leather its great strength. Leather board alone cannot withstand the tremendous lateral stresses imposed by inseam stitching and Goodyear stitching without tearing. The use of a non-fibrous member, such as a thermoplastic resin, as an abutting support component overcomes the flaw. However, since the thermoplastic resin is not visibly exposed, a strong and pliable bonded shoe welting is provided which has a lower cost than genuine leather welting and yet retains its most desirable properties of grain, color, and appearance. Moreover, because the inseam stitching to the shoe upper occurs solely within the thermoplastic resin component, the leather board is unaffected by the inseaming stress. The subsequent Goodyear stitching to the outer sole penetrates both the leather board and the thermoplastic resin components along their diagonally extending junction and results in the thermoplastic resin supporting and becoming more securely joined to the leather board at the stress points.

Figure 9:
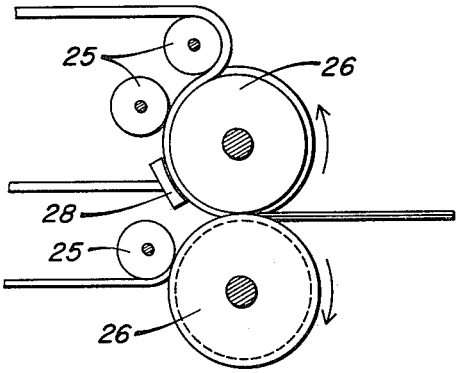
FIG. 9 is a diagrammatic view of an apparatus for making the novel shoe welt.
Figure 10:
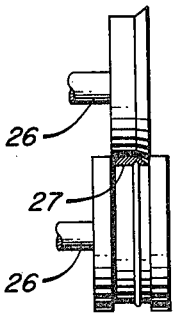
FIG. 10 is a diagrammatic cross-sectional view of the shaped rollers used in the process for making the novel shoe welt.

Referring to FIGS. 9 and 10, there is shown apparatus for joining the fibrous and non-fibrous members 2 and 16 together as one unit. After being formed as described above, the fibrous member 2 and non-fibrous member 16 are coated with cement and allowed to dry sufficiently by air or forced heat. The fibrous and non-fibrous members 2 and 16 are led towards each other using idler wheels 25 as guides. Using heating means 28 placed adjacent to the idler wheels 25, the cement coating on the fibrous member 2 is heated to become soft and tacky. The idler wheels 25 position the broad beveled upper surface 17 of the non-fibrous member 16 onto the beveled side surface 9 of the fibrous member 2. In this manner, both members are guided into a precise joining position with minimum physical stress. Once aligned against each other, the adjoined components are fed into a set of driven counter-rotating shaped rollers 26. These shaped rollers 26 intermesh with each other to form a freely turning mold 27 whose form conforms to the bonded shoe welting configuration. The shaped rollers 26 restrict and prevent the two wedge-like members 2 and 16 from sliding away in opposite directions, as would occur using direct compression, and join them into one wedge bonded unit. The mold compression force employed should be controlled, since too little pressure would not adequately seal the bond, and too much compression pressure would stretch the non-fibrous member 16 by restricting its entry into the rolling mold 27. Should the non-fibrous member component 16 become stretched, it will rebound and curl, making the sewing of the wedge bonded welting more difficult. After joining, the complete bonded welting 23 should be allowed to set without being flexed for six to twelve hours so that the cement may properly cure.

The above described method offers the user a cost efficient apparatus by which to position coils of fibrous member component onto coils of non-fibrous member component and to join them together as a bonded welting in one continuous sequential operation. However, the particular embodiment of the apparatus, the placing of machine parts, and the cyclic continuity of the apparatus is solely a matter of personal choice. Nothing in the process prevents the making of the present invention by hand without employing the aggregate of machines and tools described.

The present invention and the method for its making are not to be limited in scope nor restricted in form by the specific disclosure herein except by the appended claims.

What is claimed is:

1. A wedge bonded shoe welting adapted to be secured in a shoe comprising:
   - a member of non-fibrous composition comprising a base, a groove within the base extending along its length, and a broad beveled surface; and
   - a member of fiberboard material comprising an outer surface and an end surface, each having a grain appearance which is exposed to exterior view in an assembled shoe, and a broad beveled surface which is coextensive with and bonded to the broad beveled surface of the non-fibrous member, said fiberboard member having a generally trapezoidal cross-section, said fiberboard member being bonded to said non-fibrous member at the beveled surfaces thereof such that said non-fibrous member is hidden by said fiberboard member when secured in a shoe, thereby to prevent viewing of the non-fibrous member.

2. The wedge bonded shoe welting as recited in claim 1 wherein the composition of the non-fibrous member includes extrudable and pliant materials.

3. The wedge bonded shoe welting as recited in claim 1 wherein said non-fibrous member comprises rubber or plastic.

4. The wedge bonded shoe welting as recited in claim 1 wherein the composition of the fiberboard member includes leather fiberboard.

5. The wedge bonded shoe welting as recited in claim 1 wherein the fiberboard member further comprises a raised beading adjacent to the broad beveled surface.

6. A wedge bonded shoe welting comprising:
   - a member of non-fibrous material having a bottom surface, a broad beveled surface extending upward and inward from the bottom surface, a narrow beveled surface extending from the broad beveled surface and a groove in the bottom surface extending along the length thereof; and
   - a member of fiberboard material having a broad beveled surface coextensive with and bonded to the broad beveled surface of the non-fibrous member, a bottom surface coplanar with the bottom surface of the non-fibrous member, a top surface and an end surface each having a leather-like appearance;

the welt adapted to be affixed to a shoe with the bottom surface of both members supported on an upper surface of the outer sole, with the narrow beveled surface of the non-fibrous member engaging a portion of the shoe upper near the sole, the top and end surfaces of the fiberboard member being substantially the only visible portion of the welting in an assembled shoe.

7. The wedge bonded shoe welting as recited in claim 6 wherein said groove in the bottom surface of the non-fibrous member is configured to enclose portions of the inseam stitching.

* * * * *